US008702087B2

(12) United States Patent
Furuhashi et al.

(10) Patent No.: US 8,702,087 B2
(45) Date of Patent: Apr. 22, 2014

(54) SHEET HANDLING APPARATUS, IMAGE FORMING SYSTEM, AND SHEET RECEPTION CONTROL METHOD

(75) Inventors: Tomohiro Furuhashi, Kanagawa (JP); Masahiro Tamura, Kanagawa (JP); Shuuya Nagasako, Kanagawa (JP); Keisuke Sugiyama, Tokyo (JP); Yuusuke Shibasaki, Kanagawa (JP); Kazuya Yamamoto, Kanagawa (JP); Kyosuke Nakada, Kanagawa (JP); Yasuo Niikura, Miyagi (JP); Junya Suzuki, Miyagi (JP); Kazunori Konno, Miyagi (JP); Tomomichi Hoshino, Kanagawa (JP); Akira Kunieda, Tokyo (JP); Takahiro Watanabe, Kanagawa (JP); Tomohiro Yoshizaki, Saitama (JP); Kiichiro Goto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 11 days.

(21) Appl. No.: 13/443,312

(22) Filed: Apr. 10, 2012

(65) Prior Publication Data

US 2012/0282004 A1 Nov. 8, 2012

(30) Foreign Application Priority Data

May 2, 2011 (JP) ..... 2011-102904

(51) Int. Cl.
*B65H 9/00* (2006.01)
*B65H 31/34* (2006.01)

(52) U.S. Cl.
USPC ..... 270/58.27; 270/58.12; 270/58.17

(58) Field of Classification Search
USPC ..... 270/58.12, 58.16, 58.17, 58.27
See application file for complete search history.

(56) References Cited

U.S. PATENT DOCUMENTS

| | | | | |
|---|---|---|---|---|
| 5,382,011 | A * | 1/1995 | Tani | 270/37 |
| 6,022,011 | A * | 2/2000 | Hirose | 270/37 |
| 6,209,864 | B1 * | 4/2001 | Taniguchi et al. | 271/220 |
| 6,382,615 | B1 * | 5/2002 | Ishiguro et al. | 270/58.12 |
| 7,747,212 | B2 * | 6/2010 | Yamamoto | 399/408 |
| 7,758,035 | B2 * | 7/2010 | Tamura et al. | 270/58.07 |
| 7,802,789 | B2 | 9/2010 | Tokita et al. | |
| 7,862,016 | B2 * | 1/2011 | Takemoto et al. | 270/37 |

(Continued)

FOREIGN PATENT DOCUMENTS

| | | | |
|---|---|---|---|
| JP | 2009263127 | A | 11/2009 |
| JP | 4774362 | B2 | 7/2011 |
| JP | 2012-126515 | | 7/2012 |

OTHER PUBLICATIONS

English language abstract for JP 2008-156073 corresponds to JP 4774362.

*Primary Examiner* — Leslie A Nicholson, III
(74) *Attorney, Agent, or Firm* — Harness, Dickey & Pierce, P.L.C.

(57) ABSTRACT

A sheet handling apparatus includes a sheet reception unit configured to receive a sheet; an alignment unit configured to align the sheet in a conveying direction of the sheet, a trailing edge of the sheet in the conveying direction coming into contact with the alignment unit; and a moving unit configured to move the alignment unit along the sheet reception unit in the conveying direction. A first position for aligning and binding sheets and a second position located above the first position in the sheet reception unit are set for the alignment unit as receiving positions at which the sheet is received from the sheet reception unit.

6 Claims, 15 Drawing Sheets

(56) References Cited

U.S. PATENT DOCUMENTS

| | | | | |
|---|---|---|---|---|
| 7,905,473 | B2 | 3/2011 | Tamura et al. | |
| 7,950,641 | B2 | 5/2011 | Kikkawa et al. | |
| 7,988,139 | B2 * | 8/2011 | Matsuura | 270/58.12 |
| 8,002,274 | B2 | 8/2011 | Saito et al. | |
| 8,141,861 | B2 * | 3/2012 | Kamiya | 270/37 |
| 8,485,514 | B2 * | 7/2013 | Sugiyama et al. | 270/58.09 |
| 8,496,239 | B2 * | 7/2013 | Furuhashi et al. | 270/58.09 |
| 2009/0039593 | A1 | 2/2009 | Kikkawa et al. | |
| 2009/0152789 | A1 | 6/2009 | Kikkawa et al. | |
| 2009/0200725 | A1 | 8/2009 | Tamura et al. | |
| 2009/0206547 | A1 | 8/2009 | Tokita et al. | |
| 2009/0218746 | A1 * | 9/2009 | Matsuura | 270/58.08 |
| 2009/0258774 | A1 | 10/2009 | Suzuki et al. | |
| 2009/0283961 | A1 | 11/2009 | Saito et al. | |
| 2010/0007072 | A1 * | 1/2010 | Kamiya | 270/37 |
| 2010/0148417 | A1 | 6/2010 | Suzuki et al. | |
| 2010/0207314 | A1 | 8/2010 | Hattori et al. | |
| 2011/0184889 | A1 | 7/2011 | Tokita et al. | |
| 2011/0220557 | A1 | 9/2011 | Sasaki et al. | |
| 2011/0277418 | A1 | 11/2011 | Kunieda et al. | |
| 2012/0146279 | A1 * | 6/2012 | Furuhashi et al. | 270/58.16 |
| 2012/0153556 | A1 * | 6/2012 | Sugiyama et al. | 270/58.08 |

* cited by examiner

SHEET HANDLING APPARATUS, IMAGE FORMING SYSTEM, AND SHEET RECEPTION CONTROL METHOD

CROSS-REFERENCE TO RELATED APPLICATIONS

The present application claims priority to and incorporates by reference the entire contents of Japanese Patent Application No. 2011-102904 filed in Japan on May 2, 2011.

BACKGROUND OF THE INVENTION

1. Field of the Invention

The present invention relates to a sheet handling apparatus, an image forming system, and a sheet reception control method.

2. Description of the Related Art

There is a conventionally-known apparatus called a finisher that includes a stapler that stacks the sheet discharged from an image forming apparatus on a staple tray, aligns the sheet in a conveying direction (i.e., a vertical direction) of the sheet and in a direction (i.e., a width direction) perpendicular to the conveying direction, and then binds the sheets. When the stapler performs end-face binding, the sheet is in contact with and is held by a reference fence, which defines the position of the sheet in the sheet conveying direction, during end-face binding. At that time, the stapler moves along the edge of the sheet (usually, the trailing edge of the sheet) in a direction perpendicular to the sheet conveying direction so that the binding position can be changed.

Such a technology for positioning by using the above reference fence is disclosed in Japanese Patent Application Laid-open No. 2008-156073 and Japanese Patent Application Laid-open No. 2009-263127, for example.

In order to eliminate the need for the structure for retracting a binding device and the driving source for a trailing-edge fence so as to achieve a reduction in cost and space, for example, Japanese Patent Application Laid-open No. 2008-156073 discloses a sheet handling apparatus that performs a predetermined process on a conveyed sheet material and then discharges the sheet material. The sheet handling apparatus includes an intermediate tray that temporarily receives a conveyed sheet material to be stacked thereon; a trailing-edge fence that is in contact with the trailing edges of the sheet materials stacked on the intermediate tray and conveys the sheet materials to the transfer position; a release claw that takes over the conveyance from the trailing-edge fence downstream of the transfer position and then conveys the sheet materials from the intermediate tray; and a conveyance driving mechanism that drives the trailing-edge fence and the release claw by using the driving force from one motor.

Furthermore, Japanese Patent Application Laid-open No. 2009-263127 discloses a sheet post-handling apparatus that ensures that the leading edge of the sheet is in contact with an end stopper for alignment. The sheet post-handling apparatus includes a discharge roller that conveys the sheet discharged from the image forming apparatus so as to discharge and stack the sheet on an alignment tray that is arranged at a tilt; and includes a movable end stopper that brings the trailing edge of the sheet, which has been discharged into the alignment tray, into contact with the contact surface of the reference fence while the leading edge of the sheet is pressed so that the sheet is aligned in the conveying direction. The degree of pressure of the end stopper in the sheet conveying direction is variable.

As described above, when the sheets are sequentially stacked on the staple tray, which performs a staple process, and then subjected to a binding process, the trailing edges of the sheets come into contact with the reference fence that serves as a reference so that the trailing edges of the sheets are aligned. Such an operation is widely performed. In this type of sheet handling apparatus, the sheet discharged into the end-face binding processing tray Falls due to gravity and comes into contact with the reference fence. At that time, according to the condition of sheet, such as a soft sheet or heavy sheet, there is a possibility that, when the sheet is brought into contact with the reference fence, damage to the edge face of the sheet due to the impact to the reference fence. It is considered that the impact damage is caused by the kinetic energy of the sheet that is generated when the sheet comes into contact with the reference fence. Particularly, noticeable impact damage occurs if the falling velocity of the sheet is large, if the sheet is heavy, or if the sheet becomes easily damaged.

Therefore, there is a need for a sheet handling apparatus capable of minimizing the impact on the edge face of the sheet when the sheet comes into contact with the reference fence to prevent the occurrence of impact damage.

SUMMARY OF THE INVENTION

It is an object of the present invention to at least partially solve the problems in the conventional technology.

According to an embodiment, there is provided a sheet handling apparatus that includes a sheet reception unit configured to receive a sheet; an alignment unit configured to align the sheet in a conveying direction of the sheet, a trailing edge of the sheet in the conveying direction coming into contact with the alignment unit; and a moving unit configured to move the alignment unit along the sheet reception unit in the conveying direction. A first position for aligning and binding sheets and a second position located above the first position in the sheet reception unit are set for the alignment unit as receiving positions at which the sheet is received from the sheet reception unit.

According to another embodiment, there is provided an image forming system that includes the sheet handling apparatus according to the above embodiment; and an image forming apparatus that includes an image forming unit configured to form an image on the sheet.

According to still another embodiment, there is provided an image forming system that includes the sheet handling apparatus according to the above embodiment; and an image forming apparatus that includes an image forming unit configured to form an image on the sheet. At least one of the first position and the second position is set on the basis of sheet information for determining whether an impact damage to the sheet occurs. The image forming apparatus transmits the sheet information to the sheet handling apparatus.

According to still another embodiment, there is provided a sheet reception control method that includes receiving a sheet in a sheet reception unit; determining whether an impact damage to the sheet occurs due to an alignment unit configured to align the sheet in a conveying direction of the sheet, a trailing edge of the sheet in the conveying direction coming into contact with the alignment unit; and moving the alignment unit along the sheet reception unit in the conveying direction from a second position to a first position on the basis of a result of the determining. The first position is for aligning and binding sheets and the second position is located above the first position in the sheet reception unit, and the first position and the second position are set for the alignment unit as receiving positions at which the sheet is received from the sheet reception unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

According to embodiments of the present invention, in accordance with sheet information, such as the size, thickness, stiffness, type, or the like, of a sheet, a reference fence is moved in advance to a position close to a sheet discharge unit when the sheet is to be stacked on a staple tray so that the sheet is brought into contact with the reference fence before the kinetic energy of the discharged and falling sheet becomes large, whereby the occurrence of contact marks (impact damage) is prevented. Accordingly, the stand-by position of the reference fence is moved to an upper position from the initial position in advance in accordance with sheet-type information, or the like, and then the sheet alignment is performed in the upper section.

The sheet as described above is an example of a sheet-like recording medium, such as a conveyed sheet of paper, recording sheet, transfer sheet, or OHP sheet. Hereinafter, the sheet-like recording medium is simply referred to as the "sheet".

Exemplary embodiments of the present invention are explained in detail below with reference to the accompanying drawings.

Figure 1:
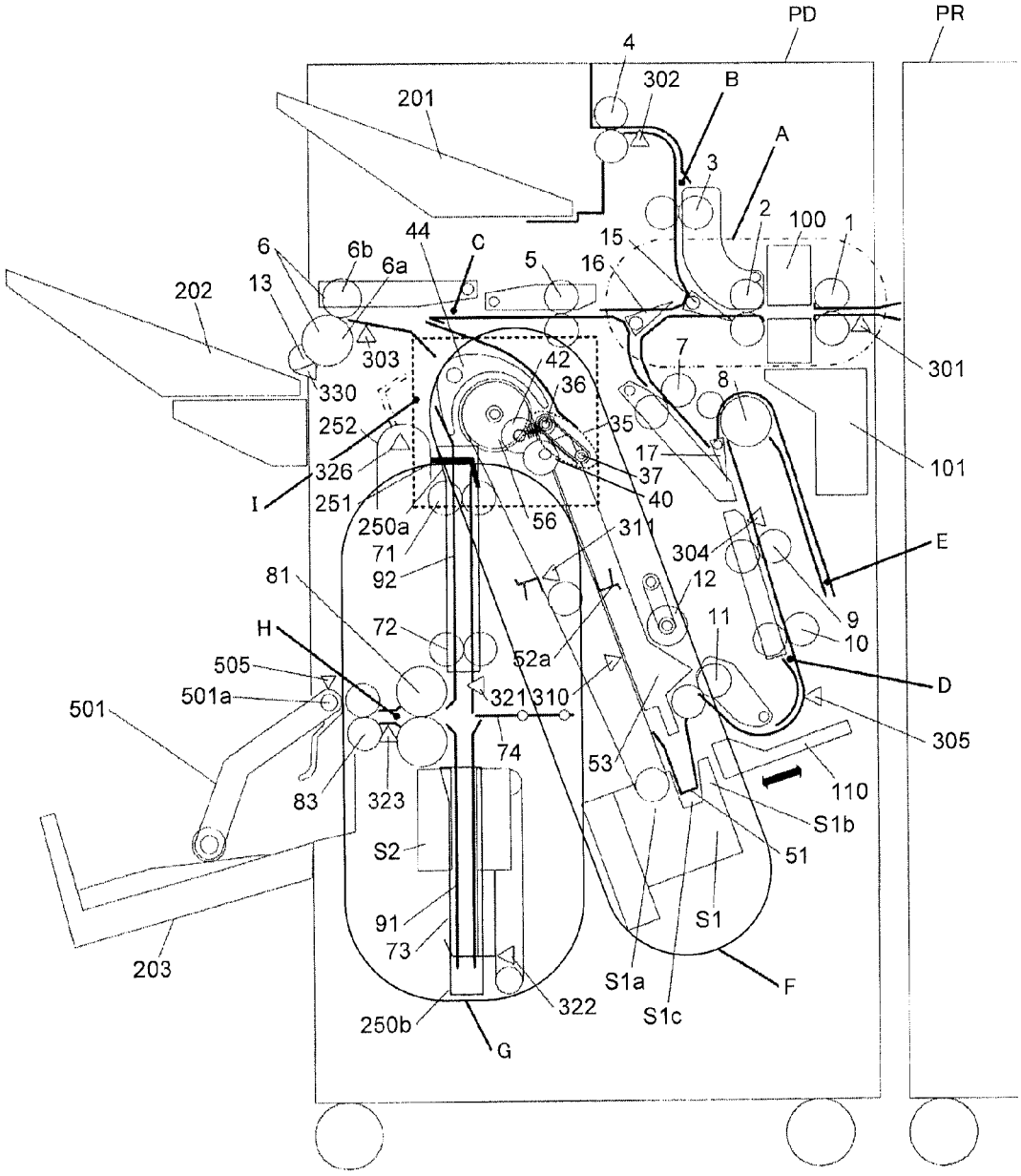
FIG. 1 is a system configuration diagram that illustrates a system that includes a sheet post-handling apparatus, which is a sheet handling apparatus according to an embodiment of the present invention, and an image forming apparatus.

FIG. 1 is a system configuration diagram that illustrates the system that includes a sheet post-handling apparatus PD, which is a sheet handling apparatus according to the present embodiment, and an image forming apparatus

PR.

As illustrated in FIG. 1, the image forming apparatus PR includes at least an image processing circuit that converts input image data into printable image data; an optical writing device that performs optical writing on a photosensitive element in accordance with an image signal output from the image processing circuit; a developing device that develops, with toner, a latent image formed on the photosensitive element due to the optical writing; a transfer device that transfers the toner image developed by the developing device to a sheet; and a fixing device that fixes the transferred toner image to the sheet. The image forming apparatus PR sends the sheet to which the toner image has been fixed to the sheet post-handling apparatus PD, and then the sheet post-handling apparatus PD performs the desired post handling. Here, the image forming apparatus PR has an electrophotographic system, as described above; however, any known image forming apparatus that has an ink-jet system, heat-transfer system, and the like can be used. According to the present embodiment, the image processing circuit, the optical writing device, the developing device, the transfer device, and the fixing device constitute an image forming unit.

The sheet post-handling apparatus PD is attached to the side of the image forming apparatus PR, and the sheet discharged from the image forming apparatus PR is delivered to the sheet post-handling apparatus PD. The sheet post-handling apparatus PD includes a conveyance path A, a conveyance path B, a conveyance path C, a conveyance path D, and a conveyance path H. The sheet is first conveyed to the conveyance path A that includes a post-handling unit (a punch unit 100 that is a punching unit according to the present embodiment) that performs post handling on one sheet.

The conveyance path B is a conveyance path that leads to an upper tray 201 through the conveyance path A, and the conveyance path C is the conveyance path C that leads to a shift tray 202. The conveyance path D is the conveyance path D that leads to an end-face binding processing tray F (functioning as a sheet reception unit) that performs alignment, staple binding, and the like. The configuration is such that the sheet is delivered from the conveyance path A to either the conveyance path B, C, or D by a separating claw 15 and a separating claw 16.

In the sheet post-handling apparatus, various processes can be performed on a sheet, such as punching (the punch unit 100), sheet alignment and end-binding (a jogger fence 53, an end-face binding stapler S1), sheet alignment and center-binding (a center-binding upper jogger fence 250*a*, a center-binding lower jogger fence 250*b*, a center-binding stapler S2), sheet sorting (the shift tray 202), and center-folding (a folding plate 74, a folding roller 81). Therefore, the conveyance path A and the following conveyance paths B, C, and D are selected. Furthermore, on the conveyance path D is included a sheet housing section E, and on the downstream side of the conveyance path D are located the end-face binding processing tray F, a center-binding center-folding processing tray G, and a sheet discharge conveyance path H.

On the conveyance path A that is located upstream of the conveyance path B, the conveyance path C, and the conveyance path D, and is common thereto, an entry sensor 301 is located to detect a sheet received from the image forming apparatus PR, and an entry roller 1, the punch unit 100, a punch waste hopper 101, a conveying roller 2, and the first and second separating claws 15, 16 are sequentially located downstream of the entry sensor 301. The first and second separating claws 15, 16 are kept in the state illustrated in FIG. 1 by undepicted springs (the initial states). When undepicted first and second solenoids are turned on, the separating claws 15, 16 are driven, respectively. When the first and second solenoids are selectively turned on/off, the combination of separation directions of the first and second separating claws 15, 16 is changed so that the sheet is delivered to either the conveyance path B, the conveyance path C, or the conveyance path D.

If the sheet is to be guided to the conveyance path B, the state illustrated in FIG. 1, i.e., the state where the first solenoid is off (the first separating claw 15 faces downward in the initial state), is kept. Thus, the sheet is delivered from a conveying roller 3 to a discharge roller 4 and then discharged into the upper tray 201.

If the sheet is to be guided to the conveyance path C, the state changes from the state illustrated in FIG. 1 in that the first and second solenoids are turned on (the second separating claw 16 faces upward in the initial state) so that a state is obtained such that the separating claw 15 rotates upward and the separating claw 16 rotates downward. Thus, the sheet is conveyed toward the shift tray 202 through a conveying roller 5 and a pair of discharge rollers 6 (6*a*, 6*b*). In this case, sheet sorting is conducted. Sheet sorting is performed by a shift-tray discharge unit that is located on the least downstream section of the sheet post-handling apparatus PD. Sheet sorting is performed by the pair of shift discharge rollers 6 (6*a*, 6*b*); a return roller 13; a sheet-surface detection sensor 330; the shift tray 202; an undepicted shift mechanism that moves the shift tray 202 back and forth in a direction perpendicular to the sheet conveying direction; and a shift-tray lifting/lowering mechanism that lifts and lowers the shift tray 202.

If the sheet is to be guided to the conveyance path D, the first solenoid that drives the first separating claw 15 is turned on and the second solenoid that drives the second separating claw is turned off so that a state is obtained such that the separating claw 15 rotates upward and the separating claw 16 rotates upward, whereby the sheet is guided from the conveying roller 2 to the conveyance path D via a conveying roller 7. After being guided to the conveyance path D, the sheet is guided to the end-face binding processing tray F. After being subjected to alignment, stapling, and the like, on the end-face binding processing tray F, the sheet is delivered by a guide member 44 to the conveyance path C that leads to the shift tray 202 or the center-binding center-folding processing tray G (hereafter, simply referred to as the "center-binding processing tray") that performs folding, and the like. If the stack of sheets is to be guided to the shift tray 202, the stack is discharged into the shift tray 202 through the pair of discharge rollers 6. Furthermore, after being guided to the center-binding processing tray G, the stack of sheets is subjected to folding and binding on the center-binding processing tray G and then discharged into a lower tray 203 through a discharge roller 83 via the sheet discharge conveyance path H.

A separating claw 17 is provided on the conveyance path D and is kept in the state illustrated in the drawing by an undepicted low-load spring. After the trailing edge of the sheet conveyed by the conveying roller 7 passes through the separating claw 17, at least a conveying roller 9 is rotated in reverse among the conveying rollers 9, 10, and a staple discharge roller 11 so that the sheet can be moved backward along a turn guide 8. Thus, a configuration is such that the sheet can be guided to the sheet housing section E, starting from the trailing edge thereof, and held there (pre-stacked) so that the sheet can be stacked with a subsequent sheet and conveyed. This operation is repeated so that two or more sheets can be stacked on one another and conveyed. The reference numeral 304 denotes a pre-stack sensor for setting a backward feed timing when a sheet is to be pre-stacked.

When the sheet is guided to the conveyance path D for sheet alignment and end-binding, the sheet is guided to the end-face binding processing tray F by the staple discharge roller 11 and is then sequentially stacked on the end-face binding processing tray F. In this case, each sheet is aligned by a tapping roller 12 in the vertical direction (sheet conveying direction) and is aligned by the jogger fence 53 in the traverse direction (a direction perpendicular to the sheet conveying direction, also referred to as the sheet width direction). The end-face binding stapler S1, which is a binding unit, is driven in accordance with a staple signal received from an undepicted control device during the interval between jobs, i.e., during the interval between the final sheet of the sheet bundle and the leading sheet of the subsequent sheet bundle, whereby a binding process is performed. After the binding process is performed, the stack of sheets is immediately delivered to the shift discharge roller 6 by a release belt (see FIG. 2) from which a release claw 52*a* protrudes and is then discharged into the shift tray 202 that is set in the receiving position.

As illustrated in FIG. 1, the end-face binding stapler S1 includes a stitcher (driver) S1*a* that inserts staples; and a clincher S1*b* that bends the ends of the staple. The space between the stitcher S1*a* and the clincher S1*b* is a space S1*c* through which reference fences 51*a*, 51*b* (collectively denoted as "51" in the drawings) can pass; therefore, the end-face binding stapler S1 is moved without interfering with the reference fences 51*a*, 51*b* (functioning as an alignment unit). The reference fences 51*a*, 51*b* function as the references for aligning the leading edge of the sheet. The end-face binding stapler S1 is different from the center-binding stapler S2 in that the stitcher S1*a* and the clincher S1*b* are integrally formed. The stitcher S1*a* does not move in a vertical direction with respect to the sheet surface and it functions as a fixed side. The clincher S1*b* moves in a vertical direction with respect to the sheet surface and it functions as a movable side. Thus, if a binding operation is performed on a sheet bundle SB, the clincher S1*b* moves toward the stitcher S1*a* at a predetermined binding area of the sheet bundle SB that is in contact with stack surfaces 51*a*1, 51*b*1 of the reference fences 51*a*, 51*b*, respectively (see FIG. 3). During this process, the binding operation is performed.

Figure 2:
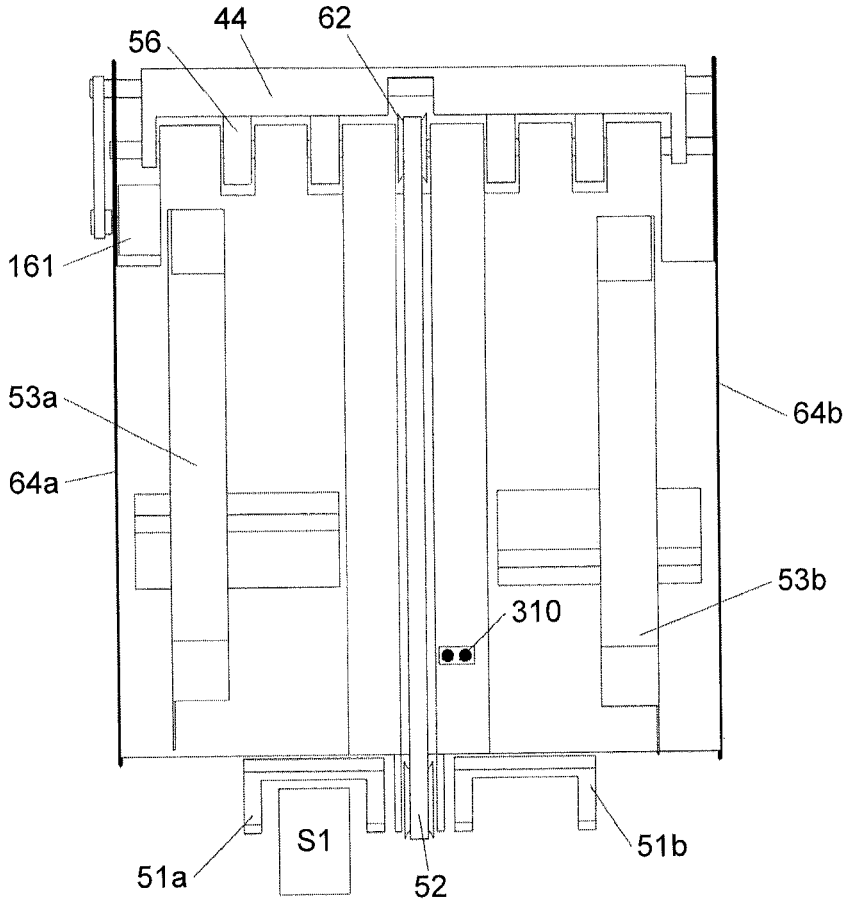
FIG. 2 is a schematic configuration diagram of an end-face binding processing tray illustrated in FIG. 1 when viewed from the tray stack surface side.
Figure 4:
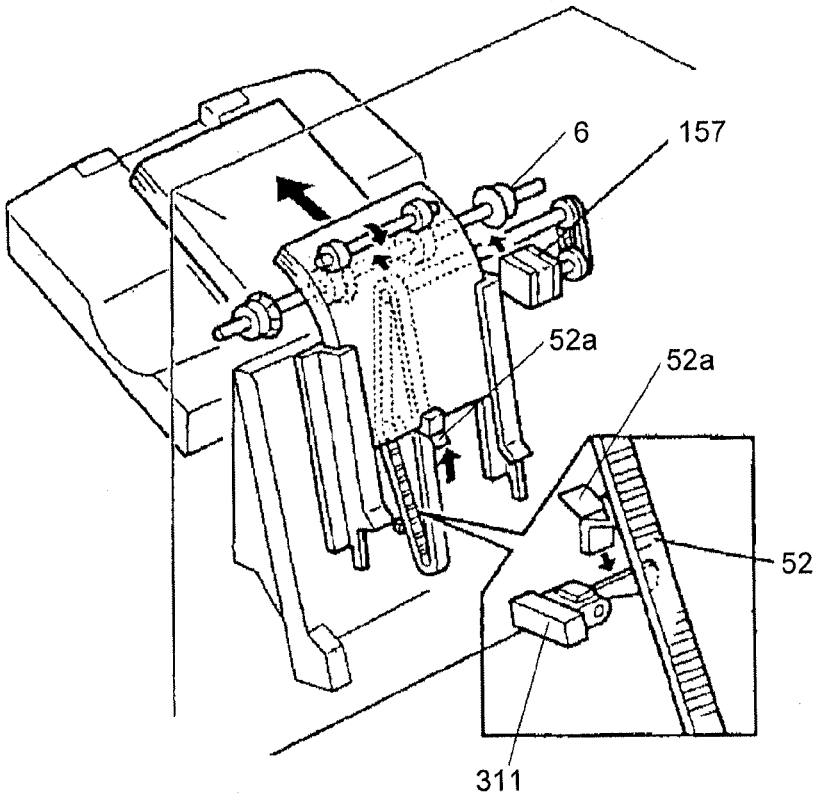
FIG. 4 is a side view that illustrates an operation of a release belt illustrated in FIG. 1.

As illustrated in FIGS. 2 and 4, the release belt 52 is located in the alignment center with respect to the sheet width direction. The release belt 52 is extended between pulleys 62 and is driven by a release-belt drive motor 157. Multiple release rollers 56 are arranged symmetrically with respect to the release belt 52. The release rollers 56 are rotatably attached to the drive shaft so as to function as driven rollers.

The home position of the release claw 52*a* is detected by a release-belt home-position (HP) sensor 311. The release-belt HP sensor 311 is turned on/off by the release claw 52*a* provided on the release belt 52. Two release claws 52*a* are provided at opposite positions on the outer circumference of the release belt 52 to alternately move and convey the sheet bundle contained in the end-face binding processing tray F. Furthermore, if needed, it is possible to rotate the release belt 52 in the opposite direction so as to align the leading edges of the sheets in the stack contained in the end-face binding processing tray F in the conveying direction by using the back side of the release claw 52*a* that is on the opposite side of the release claw 52*a* that is on stand-by to move the sheet bundle.

As illustrated in FIG. 1, the reference numeral 110 denotes a trailing-edge pressing lever. The trailing-edge pressing lever 110 is located on the lower end of the reference fence 51 so as to press the trailing edge of the sheet bundle SB contained in the reference fence 51. The trailing-edge pressing lever 110 moves back and forth in substantially a vertical direction with respect to the end-face binding processing tray F. After being discharged into the end-face binding processing tray F, each sheet is aligned by the tapping roller 12 in the vertical direction (sheet conveying direction); however, if the trailing edge of the sheet bundled on the end-face binding processing tray F is curled or if the stiffness of the sheet is low, the trailing edge of the sheet tends to bend and curl due to its own weight. Moreover, if the number of sheets stacked is increased, the space for receiving a subsequent sheet within the reference fence 51 becomes smaller; therefore, the sheet tends to be aligned in a vertical direction in a poor manner. That is why a trailing-edge pressing mechanism is provided to make the trailing edge of the sheet less curled and to make the sheet easily enter the reference fence 51. The trailing-edge pressing lever 110 directly presses the sheet.

As illustrated in FIG. 1, the reference numerals 302, 303, 304, 305, 306, and 310 denote sheet detection sensors. They detect whether a sheet has passed through the installed position or detects whether a sheet has been stacked. The reference numeral 306 denotes a staple discharge sensor, which will be described later.

Figure 6A:
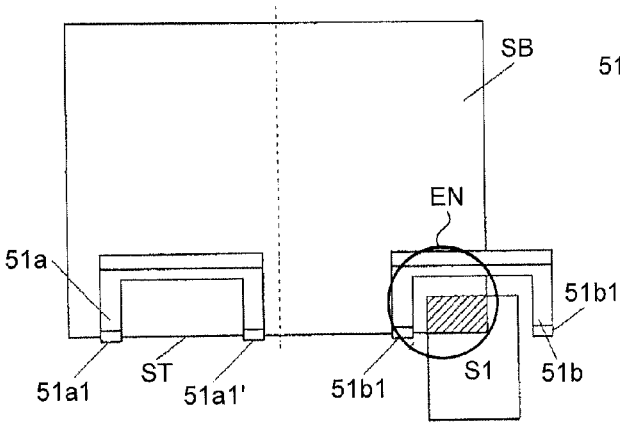
FIGS. 6A and 6B illustrate the relations among the sheet bundled on the end-face binding processing tray, reference fences, and an end-face binding stapler during end-face binding.
Figure 6B:
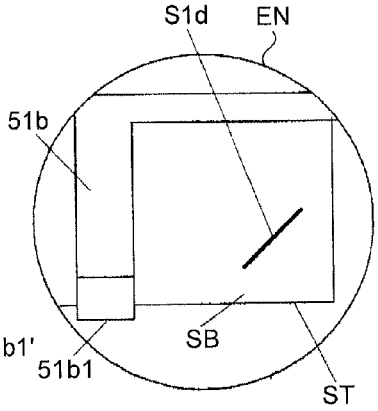

FIG. 2 is a schematic configuration diagram of the end-face binding processing tray F when viewed from the tray stack surface side, and it corresponds to the case when viewed from the right side in FIG. 1. In FIG. 2, the sheet received from the image forming apparatus PR on the upstream side is aligned in the width direction by jogger fences 53*a* and 53*b* and is aligned in the vertical direction when the sheet comes into contact with the first and second reference fences 51*a*, 51*b* (indicated by the reference numeral 51 in FIG. 1). FIG. 6A illustrates the relations among the sheet bundled on the end-face binding processing tray F, the reference fences 51*a*, 51*b*, and the end-face binding stapler S1 during end-face binding; FIG. 6B illustrates an enlargement of region EN of FIG. 6A. As can be seen from FIG. 6A, the first and second reference fences 51*a*, 51*b* include the stack surfaces 51*a*1 (51*a*1'), 51*b*1 (51*b*1'), respectively, whose inner surfaces are in contact with the sheet trailing edge ST to support them, whereby the sheet trailing edge ST is supported. As can be seen from FIG. 2, it can be supported at four points and, in the case of one-point diagonal binding, the end-face binding stapler S1 moves to the end of the sheet bundle SB and then performs a binding process in a tilted state. FIG. 6B illustrates the relation between a staple Sid and the reference fence 51*b* after binding has been performed. At that time, as illustrated in FIG. 6A, the sheet bundle SB is stacked and is in contact with any two points on the stack surfaces 51*a*1, 51*a*1', and 51*b*1 of the reference fence 51. That is because of mechanical errors including the assembly accuracy of the reference fences 51*a*, 51*b* and, as the sheet bundle SB is supported at two points, it is held in a stable state.

After the alignment operation is completed, the end-face binding stapler S1 performs a binding process. As can be seen from the perspective view in FIG. 4 that illustrates the operation of the release belt, the release belt 52 is driven by the release-belt drive motor 157 in a counterclockwise direction, and the sheet bundle on which the binding process has been performed is picked up by the release claw 52*a* attached to the release belt 52 and is then released from the end-face binding processing tray F. The reference numerals 64*a*, 64*b* denote a front side plate and a rear side plate, respectively. This operation can be performed in the same manner on an unbound stack on which the binding process is not performed after the alignment process.

Figure 3:
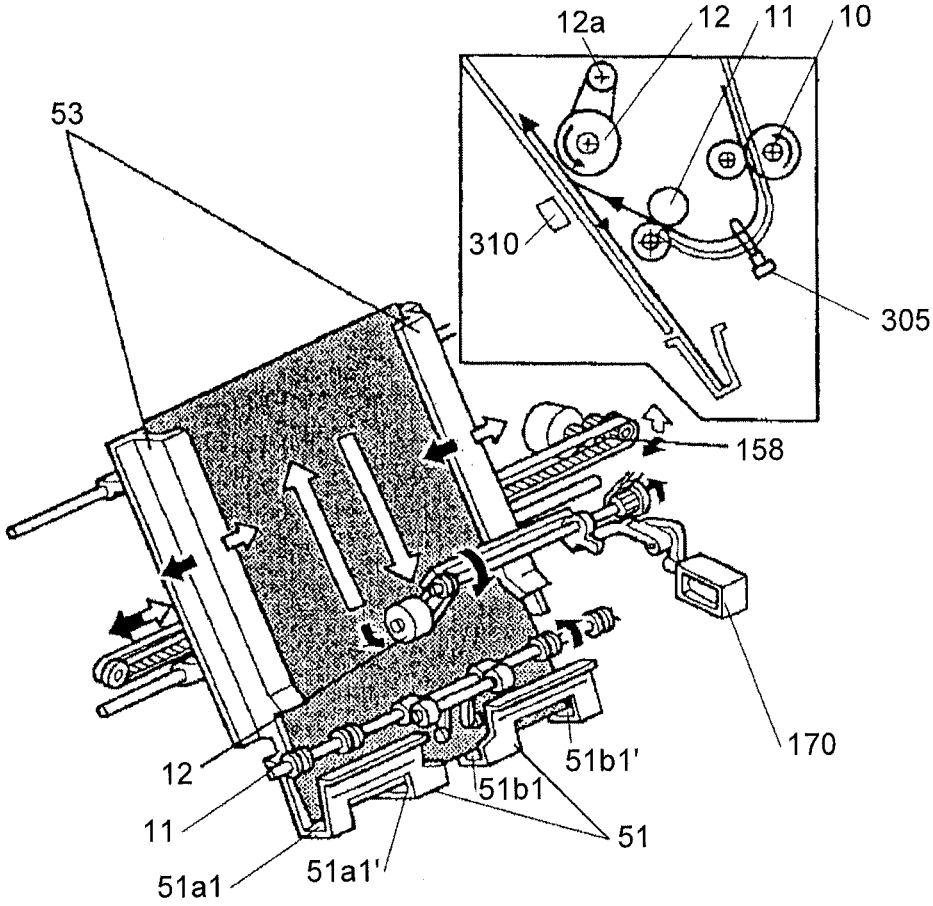
FIG. 3 is a perspective view that illustrates the schematic configuration of the end-face binding processing tray illustrated in FIG. 1 and its attached mechanism.

FIG. 3 is a perspective view that illustrates the schematic configuration of the end-face binding processing tray F and its attached mechanism. As illustrated in FIG. 3, after being guided to the end-face binding processing tray F by the staple discharge roller 11, the sheet is sequentially stacked on the end-face binding processing tray F. At that time, if one sheet is discharged into the end-face binding processing tray F, each sheet is aligned in the vertical direction (sheet conveying direction) by the tapping roller 12 and is aligned in the width direction (the sheet width direction perpendicular to the sheet conveying direction) by the jogger fences 53*a* and 53*b*. A tapping solenoid 170 applies a pendulum movement to the tapping roller 12 around a supporting point 12*a*, whereby the tapping roller 12 intermittently acts on the sheet delivered to the end-face binding processing tray F so that the sheet trailing edge ST comes into contact with the reference fence 51. The tapping roller 12 rotates in a counterclockwise direction. As illustrated in FIGS. 2 and 3, the pairs of jogger fences 53 (53*a*, 53*b*) are provided on the front and rear sides, are driven via a timing belt by a jogger motor 158 that can rotate in the normal and opposite directions, and are moved back and forth in the sheet width direction.

Figure 5:
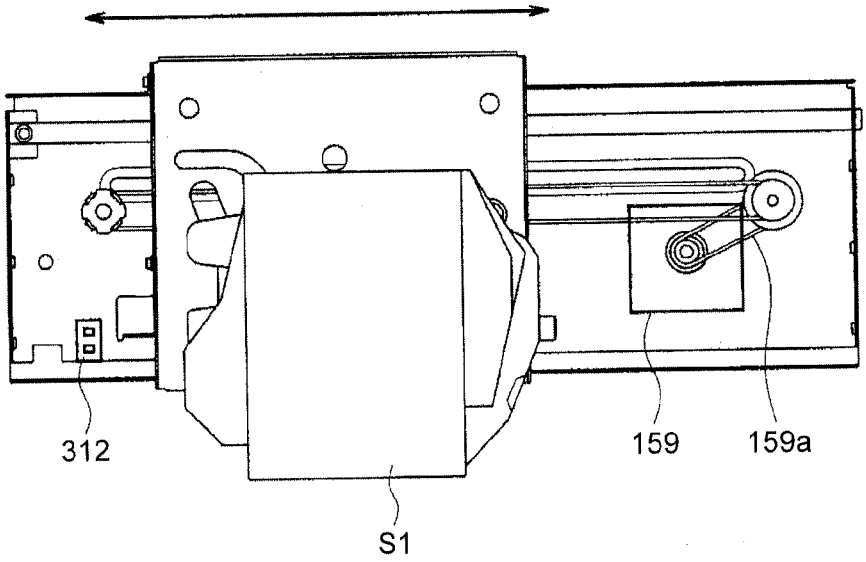
FIG. 5 is a perspective view that illustrates a stapler moving mechanism illustrated in FIG. 1.

FIG. 5 is a side view that illustrates a stapler moving mechanism. As illustrated in FIG. 5, the end-face binding stapler S1 is driven via a timing belt 159*a* by a stapler moving motor 159, which can rotate in the normal and opposite directions, and is moved in the sheet width direction so that the sheet trailing edge is bound at a predetermined position. A stapler movement HP sensor 312 is provided at one end within the movable range to detect the home position of the end-face binding stapler S1. The binding position along the sheet width direction is controlled in accordance with the moving distance of the end-face binding stapler S1 from the home position. A configuration is such that the end-face binding stapler S1 can bind the sheet trailing edge at one or more points (usually, two points) and can move along the entire width of the sheet trailing edge ST that is supported by at least the reference fences 51*a*, 51*b*. Furthermore, the maximum possible movement is to the front side of the apparatus for replacement of staples, whereby the convenience for users of the staple replacement operation is improved.

A sheet-stack turning mechanism I is provided on the downstream side of the end-face binding processing tray F along the sheet conveying direction. As illustrated in FIG. 1, the conveyance paths for conveying the sheet bundle SB from the end-face binding processing tray F to the center-binding processing tray G and from the end-face binding processing tray F to the shift tray 202 and a conveying unit for conveying the sheet bundle SB are constituted by a conveying mechanism 35 that applies a conveyance force to the sheet bundle SB; the release roller 56 that turns the sheet bundle SB; and the guide member 44 that guides the sheet bundle SB so that the sheet bundle SB is turned. An explanation is given of the detailed configuration of each unit. A configuration is such that the driving force of a drive shaft 37 is transmitted to a roller 36 of the conveying mechanism 35 via a timing belt. The roller 36 and the drive shaft 37 are connected to each other and are supported via an arm, and the roller 36 is swingable around the drive shaft 37 as its rotation support point. The roller 36 of the conveying mechanism 35 is driven and swung by a cam 40. The cam 40 rotates about its rotation axis and is driven by an undepicted motor. In the conveying mechanism 35, a driven roller 42 is located at the position opposed to the roller 36. The sheet bundle is sandwiched between the driven roller 42 and the roller 36 and is pressed by an elastic member so that a conveyance force is applied.

The conveyance path for turning the sheet bundle from the end-face binding processing tray F to the center-binding processing tray G is formed between the release roller 56 and the inner surface of the guide member 44 that is opposed to the release roller 56. The guide member 44 rotates around its supporting point, and its driving force is transmitted from a stack-separation drive motor 161 (see FIG. 2). To convey the sheet bundle from the end-face binding processing tray F to the shift tray 202, the guide member 44 rotates around its supporting point in the illustrated clockwise direction so that the space between the outer surface of the guide member 44 (the surface that is not opposed to the release roller 56) and a guide plate located on the outside thereof function as a conveyance path. To convey the sheet bundle SB from the end-face binding processing tray F to the center-binding processing tray G, the trailing edge of the sheet bundle SB, which has been aligned by the end-face binding processing tray F, is pushed up by the release claw 52*a*, and the sheet bundle is nipped between the roller 36 of the conveying mechanism 35 and the driven roller 42 that is opposed to the roller 36 so that a conveyance force is applied. At that time, the roller 36 of the conveying mechanism 35 stands by at a position where it does not hit the leading edge of the sheet bundle SB. Then, after the leading edge of the sheet bundle SB passes by, the roller 36 of the conveying mechanism 35 is brought into contact with the surface of the sheet so that a conveyance force is applied. At that time, the guide for a turn conveyance path is formed by the guide member 44 and the release roller 56, and the sheet bundle SB is conveyed downstream to the center-binding processing tray G.

As illustrated in FIG. 1, the center-binding processing tray G is provided downstream of the sheet-stack turning mechanism that includes the conveying mechanism 35, the guide member 44, and the release roller 56. The center-binding processing tray G is arranged in substantially a vertical direction on the downstream side of the sheet-stack turning mechanism. A center-folding mechanism is provided in the middle section of the center-binding processing tray G, an upper stack conveyance guide plate 92 is provided in the upper section thereof, and a lower stack conveyance guide plate 91 is provided in the lower section thereof.

An upper stack conveying roller 71 is provided in the upper section of the upper stack conveyance guide plate 92 and a lower stack conveying roller 72 is provided in the lower section thereof. The center-binding upper jogger fences 250*a* are provided on both side surfaces of the upper stack conveyance guide plate 92 and are extended between the rollers 71, 72. In the same manner, the center-binding lower jogger fences 250*b* are provided on both side surfaces of the lower stack conveyance guide plate 91. A center-binding stapler S2 is provided at the position where the center-binding lower jogger fences 250*b* are located. The center-binding upper jogger fence 250*a* and the center-binding lower jogger fence 250*b* are driven by an undepicted drive mechanism to perform an alignment operation in a direction (sheet width direction) perpendicular to the sheet conveying direction. The center-binding stapler S2 includes a pair of a clincher unit and a driver unit. Two pairs are provided at a predetermined interval in the sheet width direction.

A movable reference fence 73 is provided such that it passes across the lower stack conveyance guide plate 91 and can be moved in the sheet conveying direction (the vertical direction in the drawing) by a moving mechanism that includes a timing belt and its driving mechanism. As illustrated in FIG. 1, the driving mechanism includes a drive pulley and a driven pulley between which the timing belt is extended and includes a stepping motor that drives the drive pulley. In the same manner, a trailing-edge tapping claw 251 and its driving mechanism are provided on the upper end of the upper stack conveyance guide plate 92. The trailing-edge tapping claw 251 can be moved back and forth by a timing belt 252 and an undepicted driving mechanism in a direction away from the sheet-stack turning mechanism and in a direction for pushing the trailing edge of the sheet bundle (the side to be in contact with the trailing edge when the sheet bundle is delivered).

The center-folding mechanism is provided in substantially the middle of the center-binding processing tray G and includes the folding plate 74, the folding roller 81, and the conveyance path H for conveying the folded sheet bundle. In FIG. 1, the reference numeral 326 denotes a home-position sensor that detects the home position of the trailing-edge tapping claw 251, the reference numeral 323 denotes a folded-portion passage sensor that detects the center-folded sheet, the reference numeral 321 denotes a stack detection sensor that detects whether the sheet bundle has reached the center-folding position, and the reference numeral 322 denotes a movable reference-fence home-position sensor that detects the home position of the movable reference fence 73.

According to the present embodiment, a detection lever 501 is provided in the lower tray 203 to detect the stack height of the center-folded sheet bundle SB and is swingable around a supporting point 501*a*. The angle of the detection lever 501 is detected by a sheet-surface sensor 505 so that the lifting/lowering operation of the lower tray 203 is performed and the overflow is detected.

Figure 7:
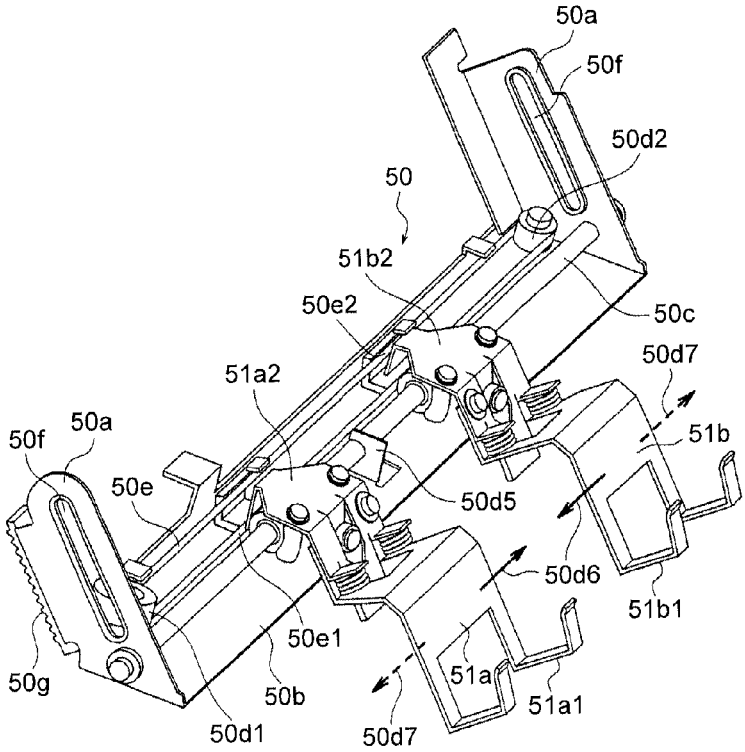
FIG. 7 is a perspective view that illustrates a moving mechanism of the reference fences in a direction perpendicular to the sheet conveying direction.
Figure 8:
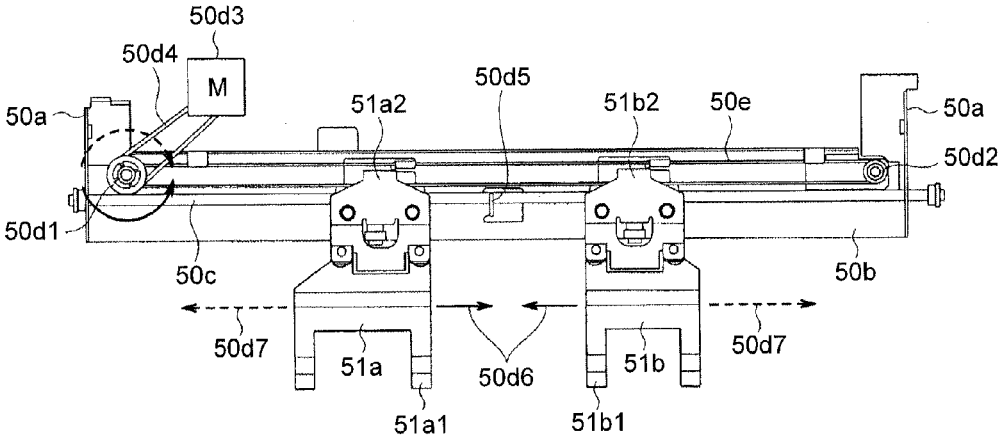
FIG. 8 is a side view of FIG. 7.

FIG. 7 is a perspective view that illustrates a moving mechanism (hereafter, referred to as the width-direction moving mechanism) 50 of the reference fences in a direction perpendicular to the sheet conveying direction, and FIG. 8 is a side view of the above.

In these drawings, the width-direction moving mechanism 50 of the reference fences includes a base 50*b*, a slide shaft 50*c*, a timing belt 50*e*, and a width-direction fence drive motor 50*d*3. Side plates 50*a* are arranged in a standing manner on both sides of the base 50*b*. The slide shaft 50*c* is fixedly supported between the side plates 50*a* so as to slidably support the supporting members 51*a*2, 51*b*2 of the reference fences 51*a*, 51*b*. The timing belt 50*e* is arranged parallel to the slide shaft 50*c* and is extended between timing pulleys 50*d*1, 50*d*2 on the drive side and the driven side. The timing pulley 50*d*1 on the drive side is driven by the width-direction fence drive motor 50*d*3 via a drive pulley 50*d*4 so that the timing belt 50*e* is rotated.

In the width-direction moving mechanism 50, the supporting member 51*a*2 of the reference fence 51*a* is provided on one side 50*e*1 of the parallel timing belt 50*e*, and the supporting member 51*b*2 of the reference fence 51*b* is provided on the other side 50*e*2 of the timing belt 50*e*. The supporting members 51*a*2, 51*b*2 are symmetrical with respect to each other about a center supporting member 50*d*5 that is in the center along the width direction. Therefore, if the timing belt 50*e* rotates, for example, counterclockwise, they move closer to the center supporting member 50*d*5 in a symmetric manner with respect to each other (in the direction of the arrow 50*d*6). If the timing belt 50*e* rotates clockwise, they move away from the center supporting member 50*d*5 in a symmetric manner (in the direction of the arrow 50*d*7). As a result, it is possible to set the positions of the stack surfaces 51*a*1, 51*b*1 and the distance therebetween in accordance with the number of rotations of the width-direction fence drive motor 50*d*3. Therefore, for example, a stepping motor is used as the width-direction fence drive motor 50*d*3 in consideration of ease and accuracy of control.

Figure 9:
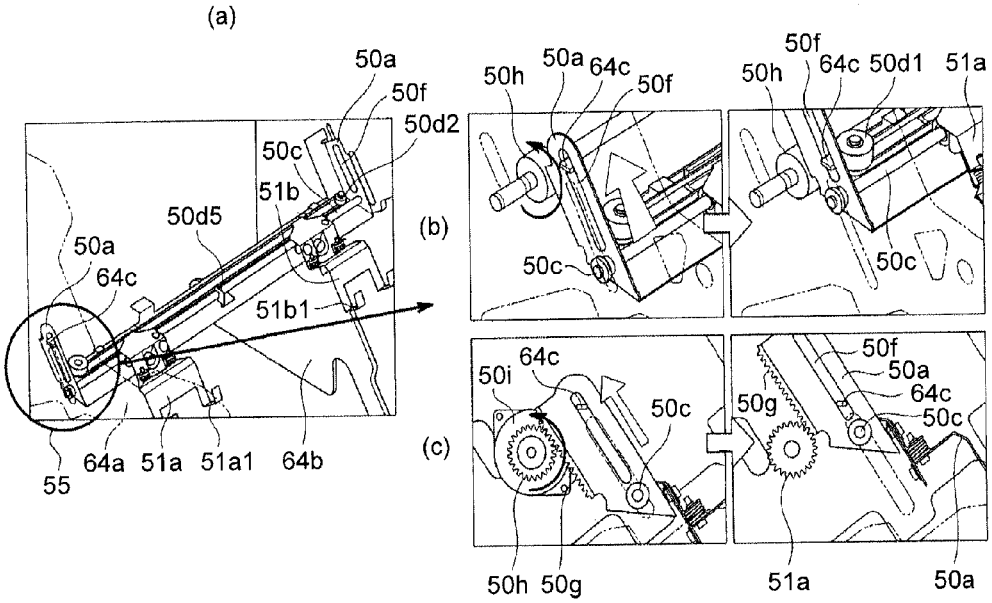
FIG. 9 is an explanatory diagram that illustrates a moving mechanism of the reference fence in the sheet conveying direction and its operation.
Figure 10:
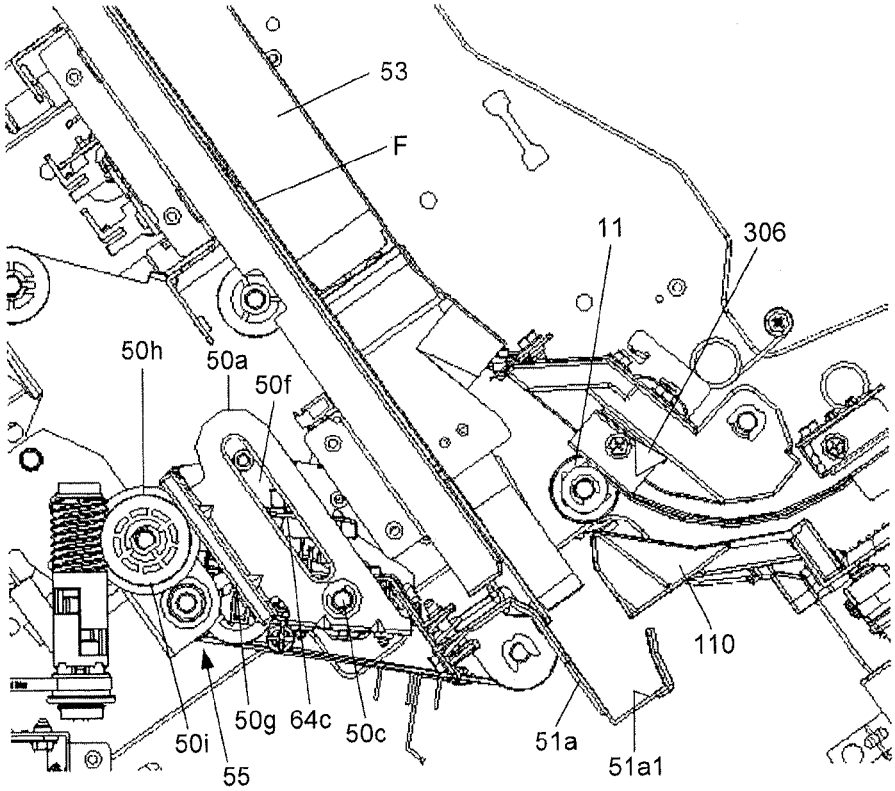
FIG. 10 is a front view that illustrates the main section of a conveying-direction moving mechanism according to the embodiment of the present invention.

FIG. 9 is an explanatory diagram that illustrates a moving mechanism (hereafter, referred to as a conveying-direction moving mechanism) 55 that moves the reference fence 51 in the sheet conveying direction and the mechanism's operation. FIG. 10 is a front view that illustrates the main section of the conveying-direction moving mechanism. In these drawings, the conveying-direction moving mechanism 55 (functioning as a moving unit) of the reference fence 51 includes a slide groove 50*f*, a protruded member 64*c*, a rack 50*g*, a pinion 50*h*, and a conveying-direction fence drive motor 50*i*. The slide grooves 50*f* are formed on the pair of side plates 50*a*, which are formed on the base 50*b* in a standing manner, and are arranged parallel to the bottom plate of the end-face binding processing tray F. The protruded members 64*c* protrude from the front side plate 64*a* and the rear side plate 64*b* and are fitted into the slide grooves 50*f* so as to limit the movable positions of the side plates 50*a* and allow movement only in a direction parallel to the bottom plate of the end-face binding processing tray F. This movement is made by the pinion 50*h* to which a driving force is transmitted from the rotation shaft of the conveying-direction fence drive motor 50*i* and by the engaging rack 50*g* that is provided on the edge surface of the side plate 50*a* on one side. According to the present embodiment, it is possible to set any position between the initial position (the lowest position) illustrated in (b) of FIG. 9 and the maximum drive position (the highest position) illustrated in (c) of FIG. 9 in accordance with the number of rotations of the conveying-direction fence drive motor 50*i*. According to the present embodiment, a stepping motor is also used as the conveying-direction fence drive motor 50*i* for easy control and position accuracy.

When the binding position in the conveying direction and the width direction is set, the end-face binding stapler S1 is moved to the binding position, as illustrated in FIGS. 5 and 6, the staple Sid is inserted from the stitcher S1*a* into the sheet bundle SB, and the clincher S1*b* is operated to bend the ends of the staple S1*d* so that the sheet bundle SB is bound. When the binding process is completed, it returns to the home position and stands by for the next operation. The sheet bundle SB is discharged from the end-face binding processing tray F by the release claw 52*a* in accordance with the rotation operation of the release belt 52.

Thus, the position of the reference fences 51*a*, 51*b* in the sheet width direction is set by the width-direction fence drive motor 50*d*3, and the position of the reference fences 51*a*, 51*b* in the sheet conveying direction is set by the conveying-direction fence drive motor 50*i*. The position of the sheet bundle SB in its width direction is changed in accordance with the sheet size and the staple position in the width direction, and the position of the sheet bundle SB in its conveying direction is changed in accordance with the set distance of the binding position from the sheet trailing edge ST. As operations do not need to be frequently performed on the conveying-direction moving mechanism 55, it is preferable that the conveying-direction moving mechanism 55 includes, for example, a worm gear that does not allow back-drive or that it includes a mechanical retaining mechanism so that necessary power is kept to the minimum.

FIGS. 11 to 14 are operation explanatory diagrams that illustrate an operation performed when the movement of the reference fence is not controlled, and FIGS. 15 to 18 are operation explanatory diagrams that illustrate an operation performed when the movement of the reference fence is controlled.

Figure 11:
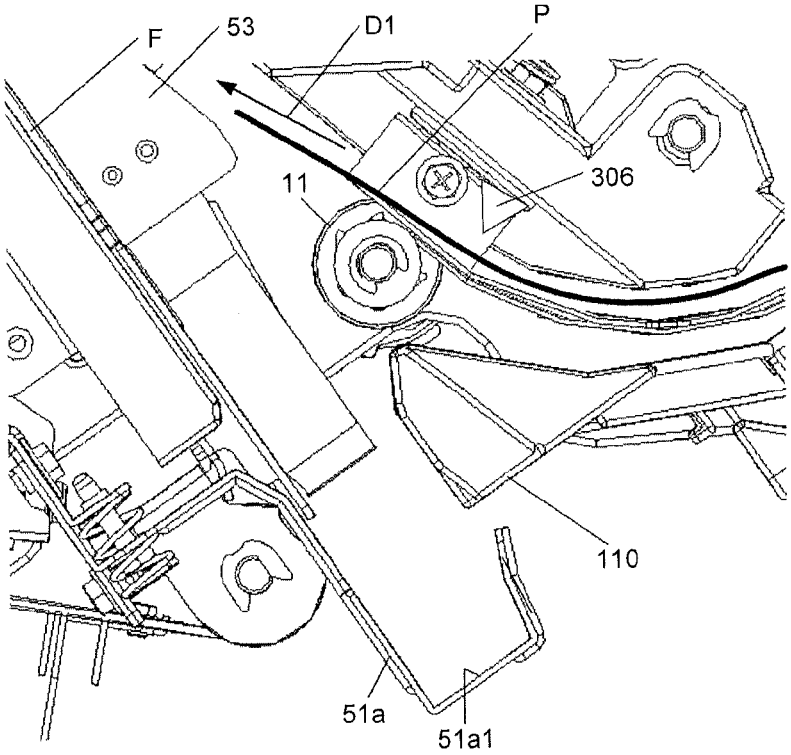
FIG. 11 is an operation explanatory diagram that illustrates an operation performed when the movement of the reference fence is not controlled and that illustrates a state where the leading edge of the sheet is being discharged into the staple tray.
Figure 12:
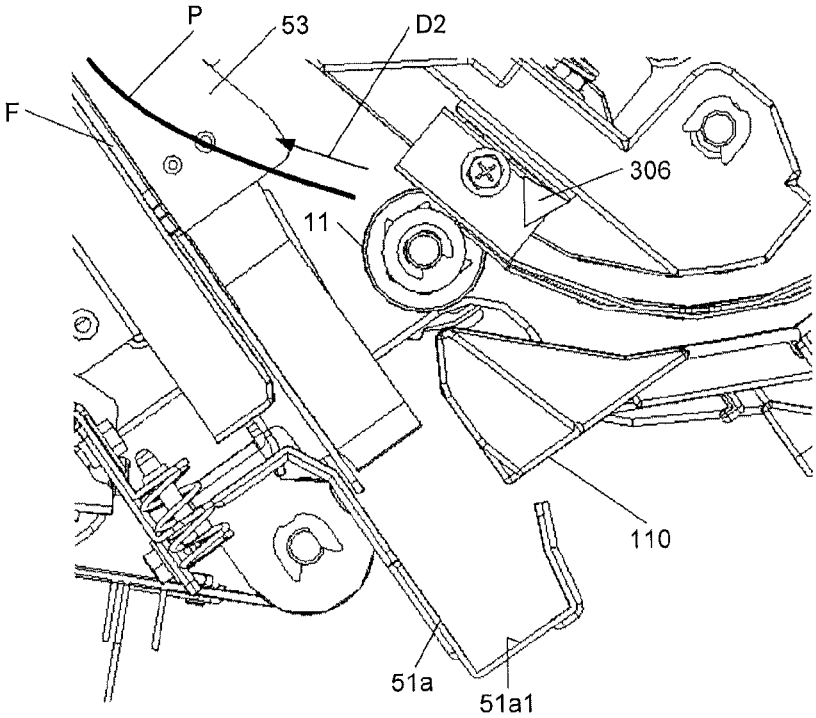
FIG. 12 is an operation explanatory diagram that illustrates an operation performed when the movement of the reference fence is not controlled and that illustrates a state where the trailing edge of the sheet is being discharged into the staple tray.
Figure 13:
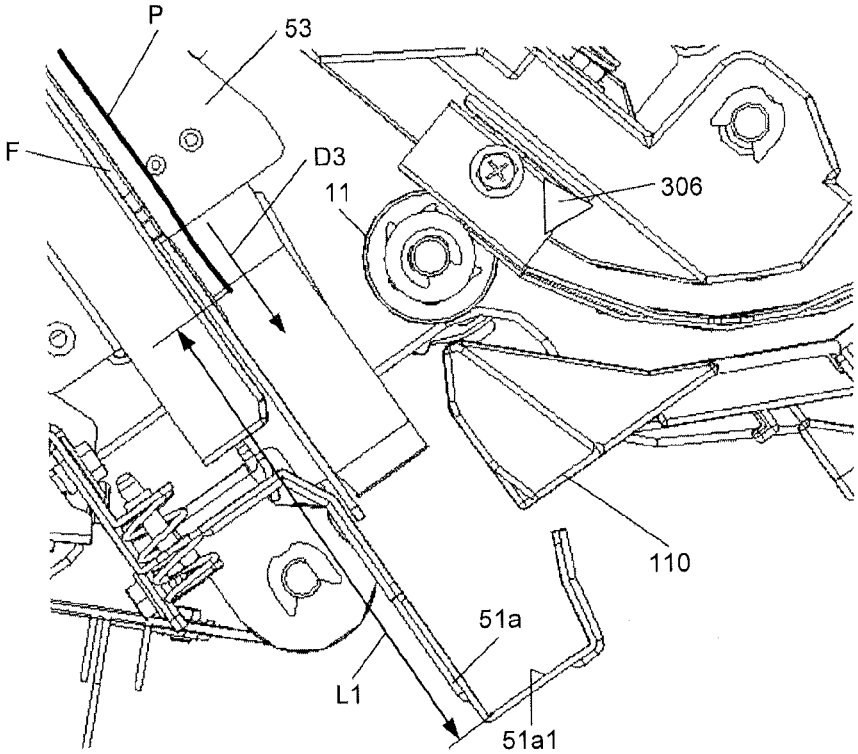
FIG. 13 is an operation explanatory diagram that illustrates an operation performed when the movement of the reference fence is not controlled and that illustrates a state where the sheet starts to fall toward the reference fence.
Figure 14:
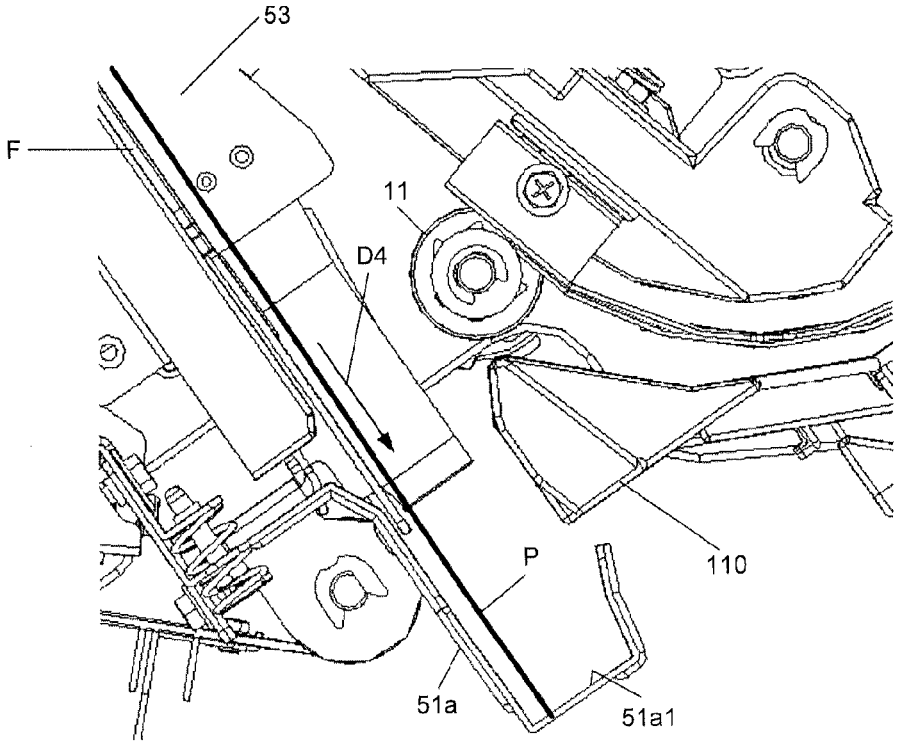
FIG. 14 is an operation explanatory diagram that illustrates an operation performed when the movement of the reference fence is not controlled and that illustrates a state where the sheet comes into contact with the reference fence.

As illustrated in FIGS. 11 and 12, the sheet P is discharged into the end-face binding processing tray F by the staple discharge roller 11 from the side of the leading edge of the sheet P in the direction of the arrow D1. At that time, as illustrated in FIG. 12, the trailing edge of the sheet P is released from the staple discharge roller 11, as indicated by the arrow D2. The sheet P lands on a position on the end-face binding processing tray F due to the inertia force during the release and gravity, as illustrated in FIG. 13, and falls along the surface of the end-face binding processing tray F from that position. At that time, the potential energy generated at the landing position is converted into kinetic energy so that, as illustrated in FIG. 14, the sheet P falls to the stack surface 51*a*1 of the reference fence 51*a* at the converted speed (in the direction of the arrow D3 illustrated in FIG. 13, and the direction of the arrow D4 illustrated in FIG. 14). When the sheet P falls from the position illustrated in FIG. 13 to the position illustrated in FIG. 14, the sheet P comes into contact with the stack surface 51*a*1 and stops. At that time, the kinetic energy corresponding to the fall distance L1 is absorbed by the trailing edge of the sheet P; however, in the case of a high-density sheet or a soft sheet that can become easily damaged, the absorption results in deformation of the edge face of the sheet, i.e., an impact damage to the edge face of the sheet appears.

Figure 15:
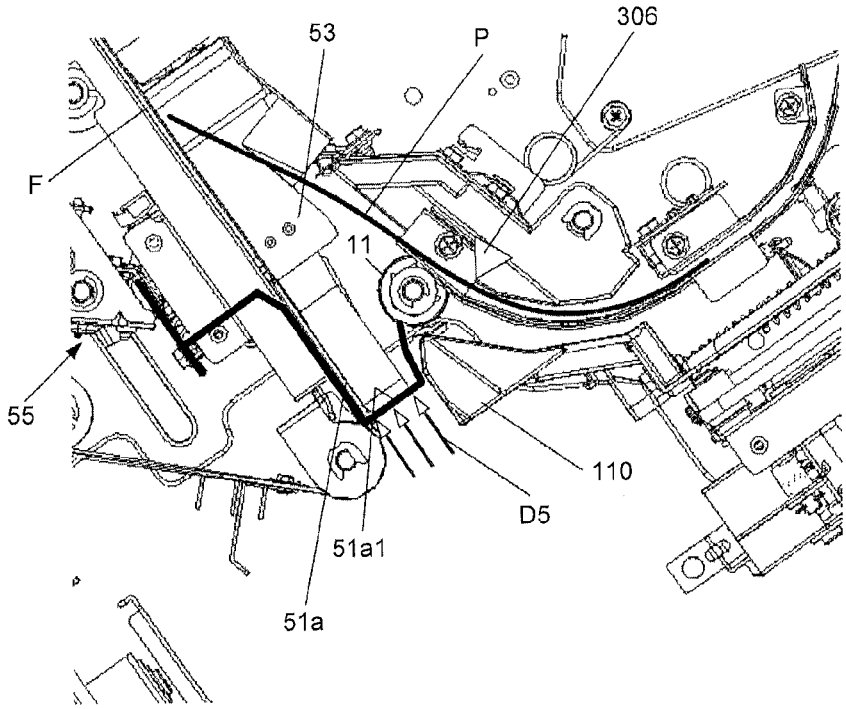
FIG. 15 is an operation explanatory diagram that illustrates an operation performed when the movement of the reference fence is controlled and that illustrates a state where the leading edge of the sheet is being discharged into the staple tray.
Figure 16:
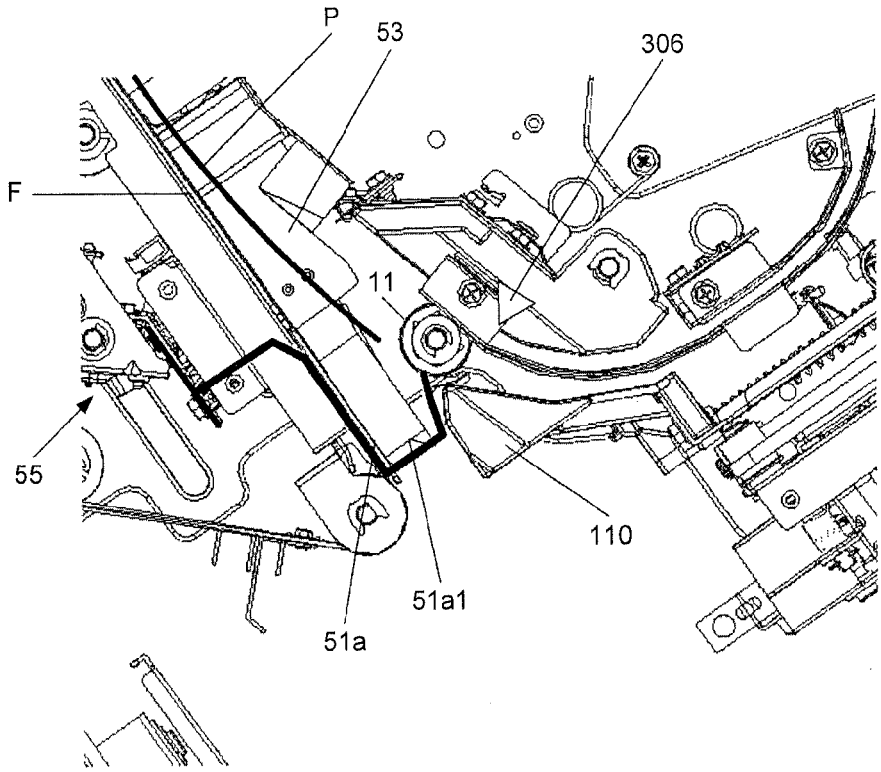
FIG. 16 is an operation explanatory diagram that illustrates an operation performed when the movement of the reference fence is controlled and that illustrates a state where the trailing edge of the sheet is being discharged into the staple tray.
Figure 17:
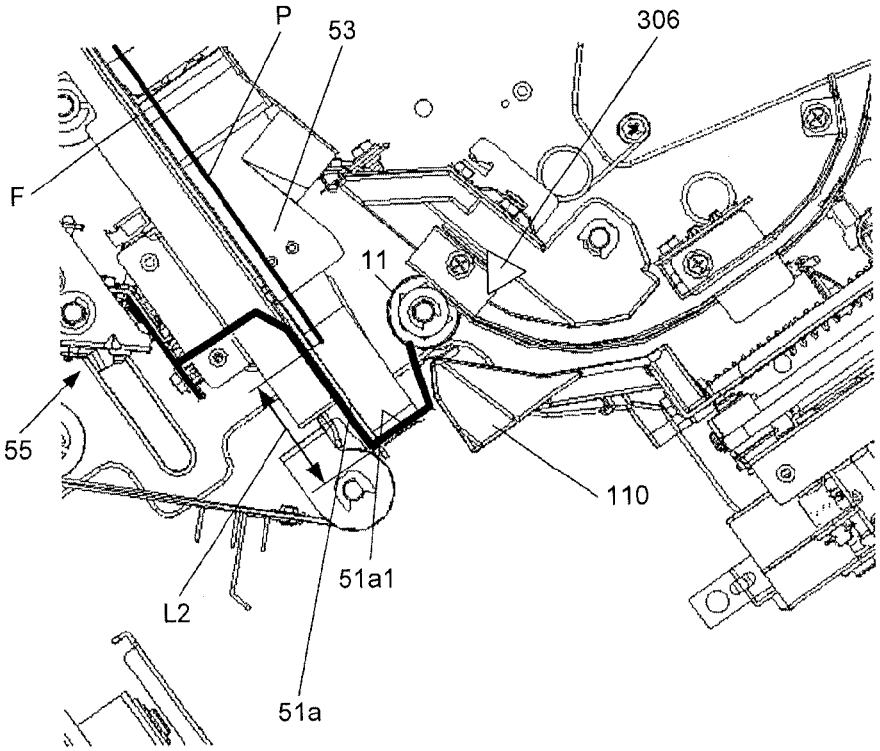
FIG. 17 is an operation explanatory diagram that illustrates an operation performed when the movement of the reference fence is controlled and that illustrates a state where the sheet starts to fall toward the reference fence.

According to the embodiment, as illustrated in FIG. 15, when the sheet P is discharged into the end-face binding processing tray F by the staple discharge roller 11, the reference fence 51 is moved up close to the staple discharge roller 11 (in the direction of the arrow D5) and waits until the sheet P is released into the end-face binding processing tray F, as illustrated in FIG. 16. This operation is completed before the sheet P is discharged into the end-face binding processing tray F. When the sheet P is released onto the end-face binding processing tray F, the sheet P falls from the position illustrated in FIG. 17 toward the stack surface 51*a*1 of the reference fence 51*a* due to its own weight. As the stack surface 51*a*1 is located close to the staple discharge roller 11, i.e., the stack surface 51*a*1 is located close to the release position of the sheet P onto the end-face binding processing tray F, the fall distance L2 is significantly smaller than the fall distance L1 illustrated in FIG. 13. Therefore, the kinetic energy corresponding to the fall distance L2 is also small, and the impact absorbed by the sheet trailing edge when it comes into contact with the stack surface 51*a*1 of the reference fence 51*a* is also small. As a result, it is possible to absorb the impact without deformation of the edge face of the sheet P.

Figure 18:
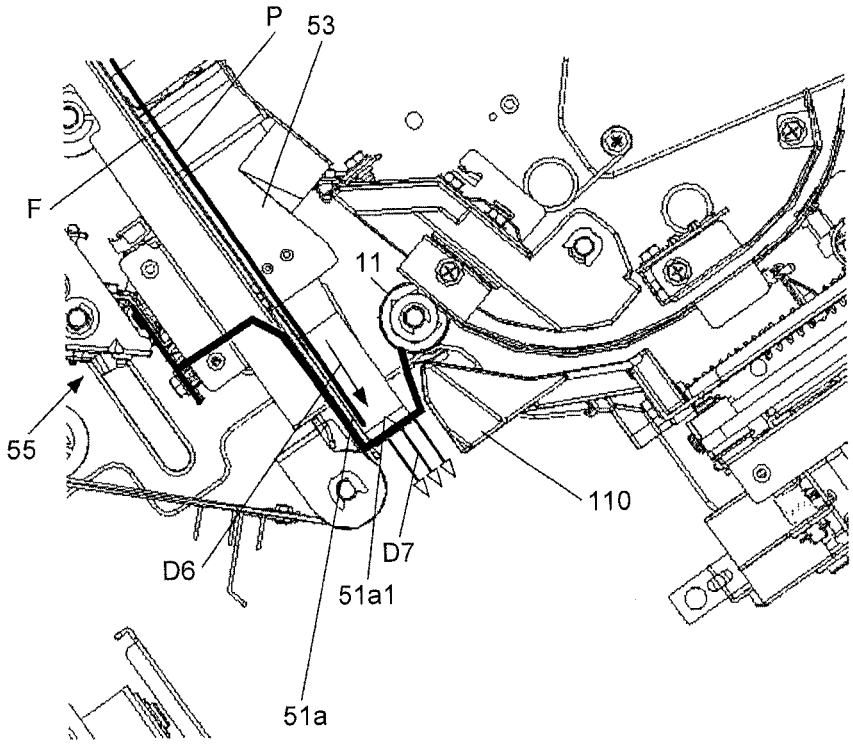
FIG. 18 is an operation explanatory diagram that illustrates an operation performed when the movement of the reference fence is controlled and that illustrates a state where the reference fence moves down just before the sheet comes into contact with the reference fence.

As illustrated in FIG. 18, the reference fence 51*a* is moved down (in the direction of the arrow D7) at a time after the sheet P moves down (in the direction of the arrow D6) and comes into contact with the stack surface 51*a*1 or at a time slightly before the sheet P comes into contact with the stack surface 51*a*1. In this case, the falling velocity of the reference fence 51*a* nearly equals the falling velocity of the sheet P. Thus, it is possible to further reduce the speed of the sheet P relative to the reference fence 51*a* when the reference fence 51*a* moves down and stops at the reference position and then the sheet P comes into contact with the stack surface 51*a*1 of the stopped reference fence 51*a*. As a result, the impact obtained when the sheet P comes into contact with the stack surface 51*a*1 of the reference fence 51*a* is smaller, and the kinetic energy to be absorbed is also smaller; therefore, the occurrence of impact damage to the sheet P can be prevented.

Figure 19:
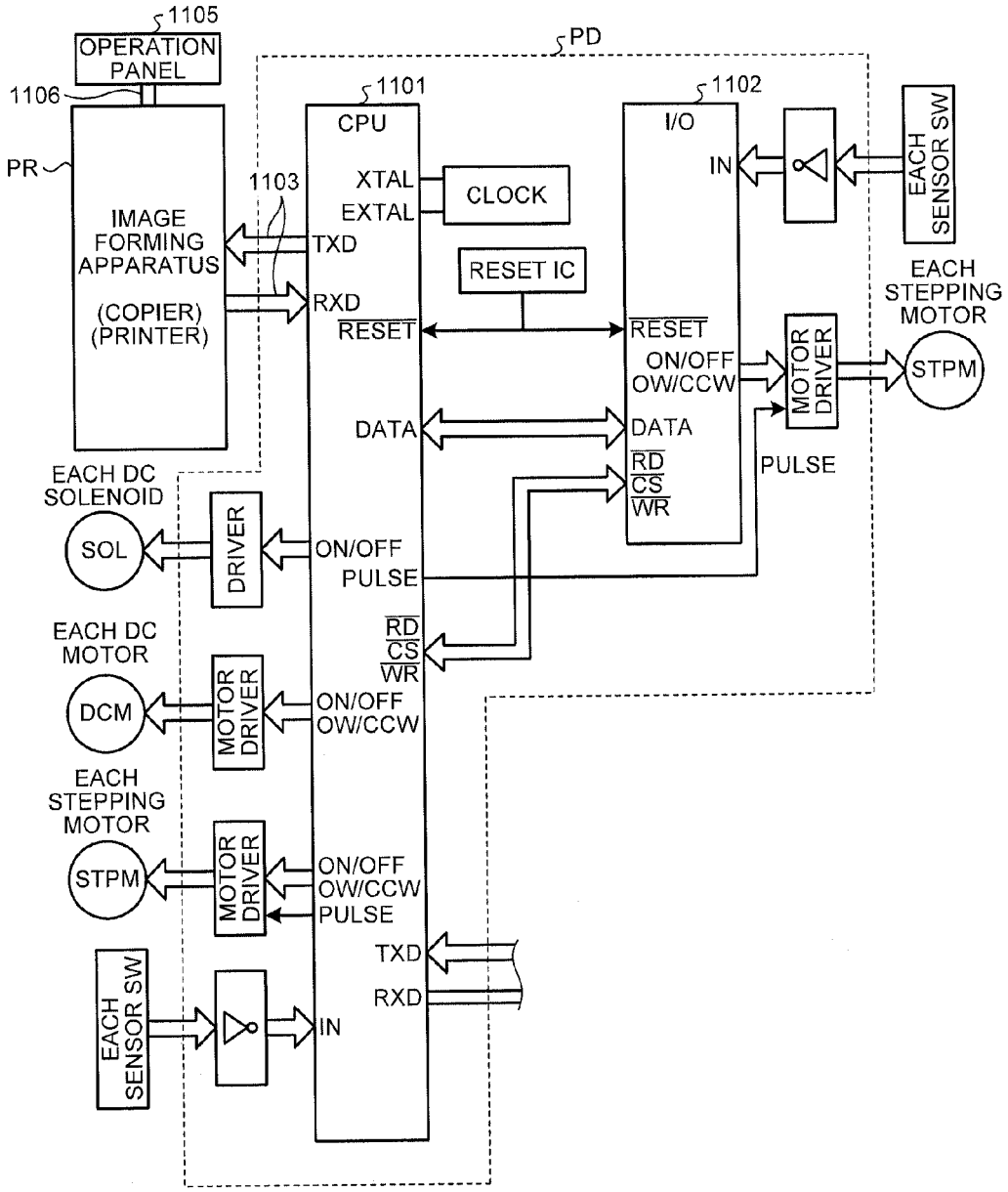
FIG. 19 is a block diagram that illustrates a control configuration of the image forming system that includes the sheet post-handling apparatus and the image forming apparatus.

The above control is performed by a control circuit of the sheet post-handling apparatus PD. FIG. 19 is a block diagram that illustrates a control configuration of the image forming system that includes the sheet post-handling apparatus PD and the image forming apparatus PR. The sheet post-handling apparatus PD includes a control circuit on which a microcomputer including a CPU 1101, an I/O interface 1102, or the like, is mounted. The CPU 1101 receives signals from a CPU of the image forming apparatus PR, each switch of an operation panel 1105, and each undepicted sensor via a communication interface 1103. The CPU 1101 performs predetermined control in accordance with input signals. Furthermore, the CPU 1101 controls and drives a solenoid and a motor via a driver or a motor driver and acquires sensor information on the apparatus from the interface. Moreover, depending on a target to be controlled or a sensor, it controls and drives a motor by using a motor driver via the I/O interface 1102 and acquires sensor information from the sensor. A program code stored in an undepicted ROM is read by the CPU 1101 and loaded in an undepicted RAM, the RAM is used as a work area and data buffer, and the above-described control is performed in accordance with the program defined by the program code.

The control of the sheet post-handling apparatus PD illustrated in FIG. 19 is performed in accordance with a command or information received from the CPU of the image forming apparatus PR. A user's operation instruction is issued through the operation panel 1105 of the image forming apparatus PR. The image forming apparatus PR is connected to the operation panel 105 via a communication interface 1106. Thus, the image forming apparatus PR transmits the operation signals received from the operation panel 1105 to the sheet post-handling apparatus PD.

Furthermore, a user or operator is notified of the processing status or functions of the sheet post-handling apparatus PD via the operation panel 1105.

Figure 20:
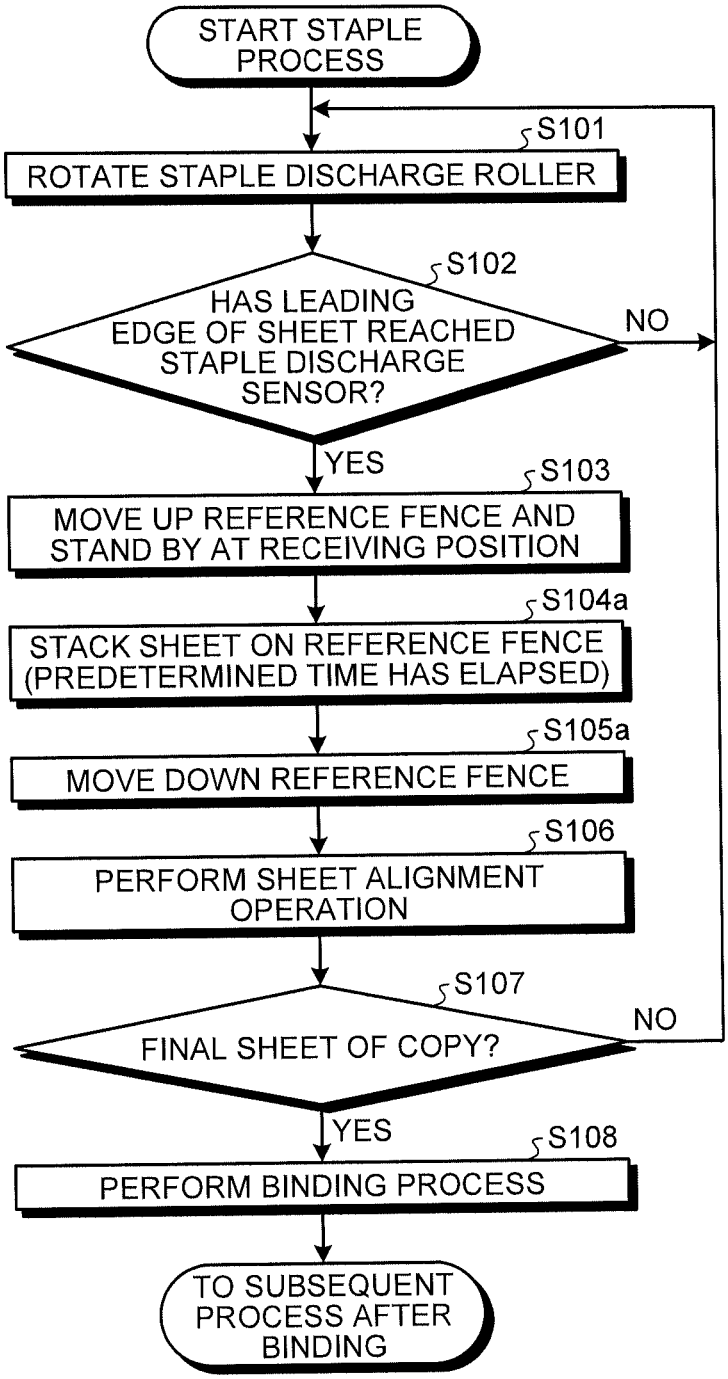
FIG. 20 is a flowchart that illustrates the steps of an operation performed when the reference fence is moved down after the sheet moves down and comes into contact with the reference fence.
Figure 21:
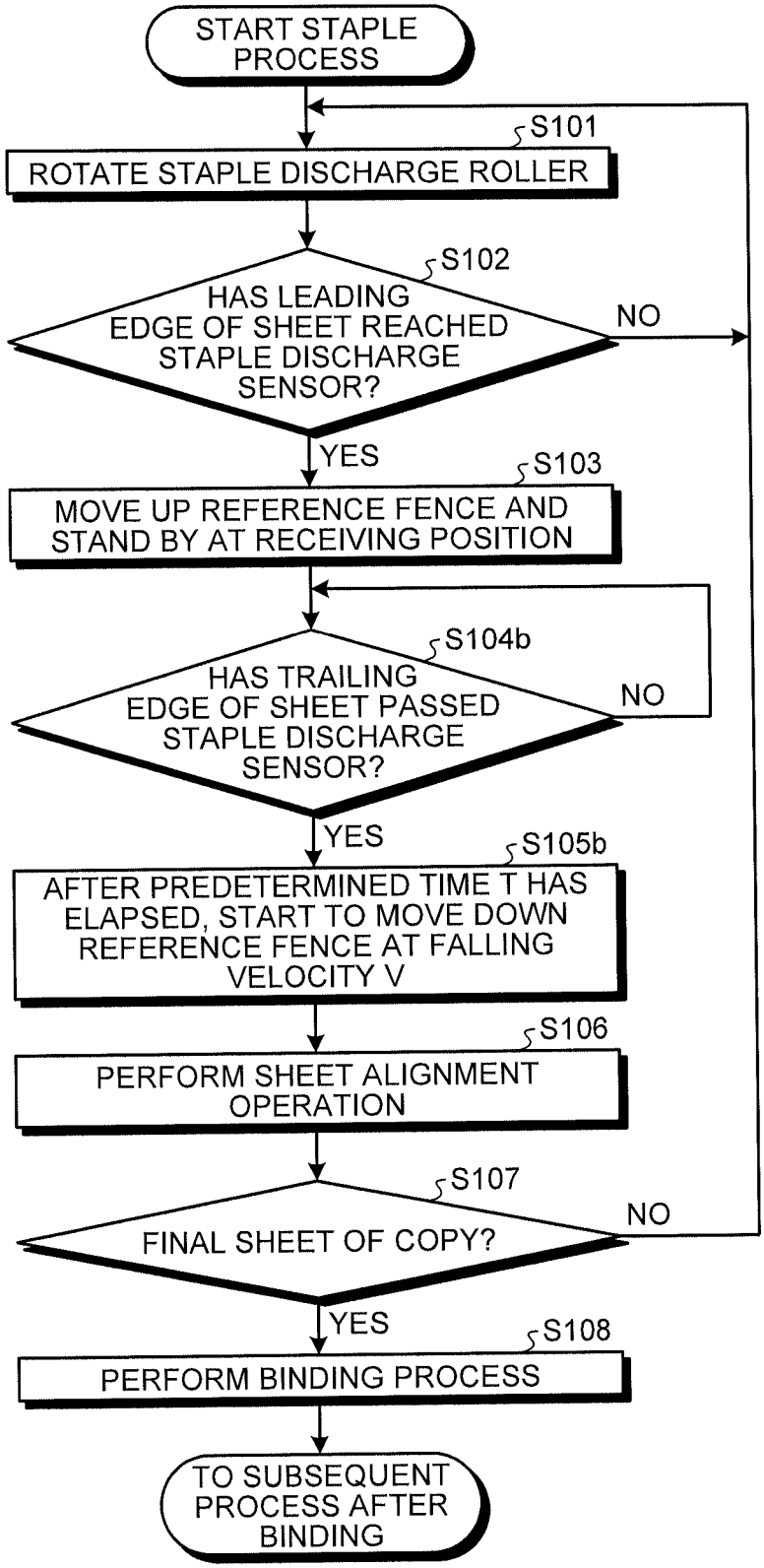
FIG. 21 is a flowchart that illustrates the steps of an operation performed when the reference fence is moved down just before the sheet moves down and comes into contact with the reference fence.
Figure 22:
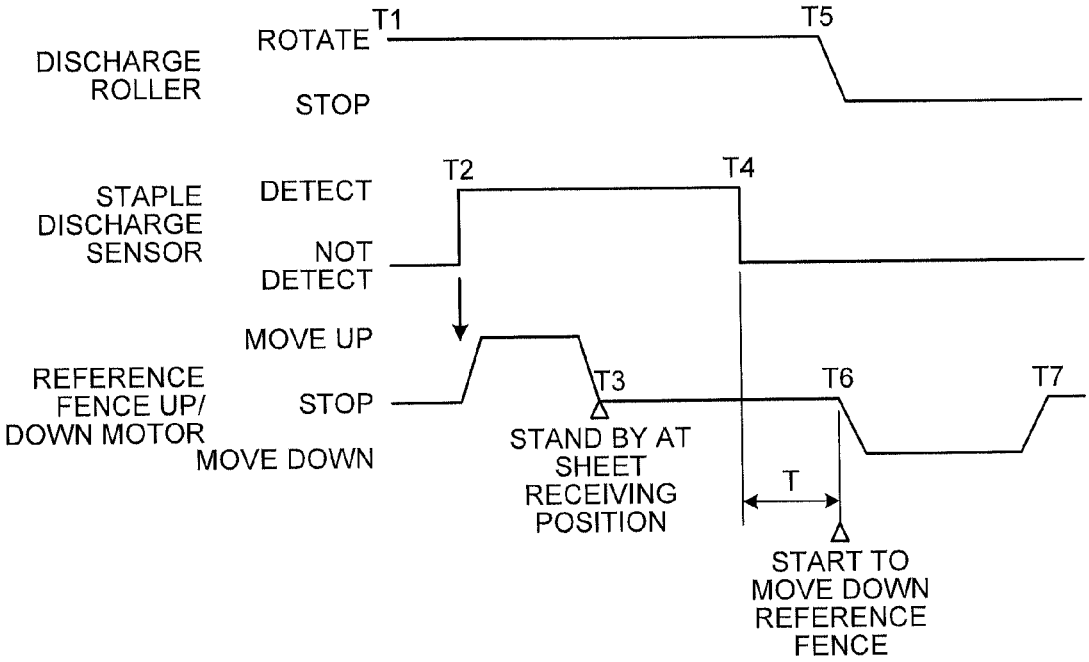
FIG. 22 is a timing chart that illustrates the operation timings of a staple discharge roller and the reference fence and the detection timing of a staple discharge sensor.

FIG. 20 is a flowchart that illustrates the steps of an operation performed when the reference fence 51*a* is moved down after the sheet P moves down and comes into contact with the stack surface 51*a*1. FIG. 21 is a flowchart that illustrates the steps of an operation performed when the reference fence 51*a* is moved down at a time slightly before the sheet P comes into contact with the stack surface 51*a*1 (at a time just before the sheet P comes into contact with the stack surface 51*a*1). FIG. 22 is a timing chart that illustrates the relations among the operation timing of the staple discharge roller 11, the driving timing of the reference fence 51*a*, and the detection timing of the staple discharge sensor 306.

If the reference fence 51*a* is moved down after the sheet P moves down and comes into contact with the stack surface 51*a*1, the staple discharge roller 11 and the conveying roller located upstream are driven and rotated, as illustrated in FIG. 20 (Step S101: T1). When the staple discharge sensor 306 detects the leading edge of the sheet P (Step S102, YES: T2), the conveying-direction fence drive motor 50*i* starts to be driven so that the reference fence 51*a* is moved up from the staple position to the sheet receiving position and stopped at the sheet receiving position (Step S103: T2→T3). After the staple discharge sensor 306 detects the trailing edge of the sheet (T4), the reference fence 51*a* stands by at the sheet receiving position for a predetermined time T (T4→T6). This predetermined time is the time it takes for the sheet P released onto the end-face binding processing tray F to move down toward the reference fence 51*a* and come into contact with the stack surface 51*a*1. Meanwhile, the staple discharge roller 11 stops (T5).

After the sheet P comes into contact with the stack surface 51*a*1 so as to be stacked (Step S104*a*), the reference fence 51*a* moves down to the staple position (Step S105*a*: T6→T7), and then the sheet alignment operation is performed (Step S106). The operation from Step S101 to Step S106 is repeated on a per-sheet basis (Step S107, NO). When the final sheet of the copy is reached (Step S107, YES), end-face binding is performed by the end-face binding stapler S1 (Step S108), and then other post-handling is performed.

If the reference fence 51*a* is moved down at a time slightly before the sheet P moves down and comes into contact with the stack surface 51*a*1, the operation is performed at Steps S101 to S103 illustrated in FIG. 21 in the same manner as in FIG. 20. At Step S103, it stands by at the sheet receiving position and waits until the sheet trailing edge passes by the staple discharge sensor 306 (Step S104*b*). After the sheet trailing edge passes by the staple discharge sensor 306 and after a predetermined time T has elapsed, the reference fence 51*a* starts to move down at the speed V (Step S105*b*). After it moves down to the staple position, the trailing edge of the sheet P, which follows from the upper portion of the reference fence 51*a*, comes into contact with the stack surface 51*a*1 so that the position of the sheet trailing edge is defined. Then, the operation from Steps S106 to S108 is performed.

At Step S103, it is determined on the basis of the sheet information fed from the image forming apparatus PR to the CPU 1101 of the sheet post-handling apparatus PD whether the reference fence 51 is to be moved up to the receiving position, as illustrated in FIG. 15. The sheet information includes information on the size, thickness, stiffness, quality (type), or the like, of the sheet. The occurrence of impact damage and the size of impact damage relate to the amount of energy when the edge face of the sheet P hits the stack surface 51*a*1 of the reference fence 51*a*. The energy is a function of mass and velocity. The size, thickness, and type of the sheet are associated with the weight, while the stiffness and quality are associated with the susceptibility to damage.

According to the present embodiment, the state of impact damage that occurs when the edge face of the sheet trailing edge comes into contact with the reference fence 51*a* in a state where the reference fence 51*a* is in the binding position is observed or measured in the laboratory in advance with respect to all of the sizes, thicknesses, rigidities, qualities (types) of sheets that can be fed by the image forming apparatus PR. Data is stored in a memory table as sheet information on the combination of the size, thickness, stiffness, and quality (type) of the sheet for which the reference fence 51*a* needs to be moved up to the receiving position (Step S104*a*) or needs to be moved up to the receiving position and then moved down in synchronization with the falling sheet (Step S105*b*) so that impact damage is prevented. That is, sheet information on sheets on which impact damage can occur is stored in the memory table.

Before performing the control illustrated in FIG. 20 or FIG. 21, the CPU 1101 of the sheet post-handling apparatus PD receives the sheet information from the CPU of the image forming apparatus PR. The received sheet information is compared with the sheet information stored in the memory table, and it is determined whether the process from Steps S103 to S105*a* or from Steps S103 to S105*b* is to be performed. During this determination, if it is determined that there is no possibility of occurrence of impact damage, the process from Steps S103 to S105*a* or from Steps S103 to S105*b* is skipped and the process from Steps S102 to S106 is performed. This process corresponds to the operation illustrated in FIGS. 11 to FIG. 14.

As described above, the present embodiment offers the following advantages:

1) the reference fence 51*a* is moved up close to the staple discharge roller 11 and the falling sheet P is received by the reference fence 51*a;* therefore, the sheet P can come into contact with the stack surface 51*a*1 of the reference fence 51*a* before the falling velocity of the sheet P has increased, and it is possible to prevent the occurrence of impact damage due to impact of the sheet P to the edge face of the sheet P;

2) the reference fence 51*a* is moved up close to the staple discharge roller 11 and then the reference fence 51*a* starts to move down at a time when the sheet P is brought into contact with the reference fence 51*a* or at a time slightly before the sheet P is brought into contact with it; therefore, it is possible to further reduce the speed of the sheet P relative to the reference fence 51*a* when the sheet P comes into contact with the reference fence 51*a*. As a result, it is possible to further reduce the impact to the sheet P and prevent the occurrence of impact damage; and 3) it is determined whether the reference fence 51*a* is to be moved up to the sheet receiving position in accordance with the sheet information; therefore, if there is no need to move up the reference fence 51*a* to the sheet receiving position, the previous operation is performed without any change, which prevents unnecessary control being performed.

According to the embodiments, it is possible to minimize the impact to the edge face of a sheet when the sheet comes into contact with an aligning unit and to prevent the occurrence of impact damage.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet reception control method comprising:

receiving a sheet in a sheet reception unit;

determining whether an impact damage to the sheet occurs due to an alignment unit configured to align the sheet in a conveying direction of the sheet, a trailing edge of the sheet in the conveying direction coming into contact with the alignment unit;

moving the alignment unit in a direction perpendicular to the conveying direction; and moving the alignment unit along the sheet reception unit in the conveying direction from a second position to a first position on the basis of a result of the determining, wherein the first position is for aligning and binding sheets and the second position is located above the first position in the sheet reception unit, and the first position and the second position are set for the alignment unit as receiving positions at which the sheet is received from the sheet reception unit.

2. The method according to claim 1, wherein moving the alignment unit from the second position to the first position is performed at a time when the trailing edge of the sheet comes into contact with the alignment unit or at a time just before the trailing edge of the sheet comes into contact with the alignment unit.

3. The method according to claim 1, wherein moving the alignment unit from the second position to the first position is performed after the trailing edge of the sheet comes into contact with the alignment unit.

4. The method according to claim 1, wherein at least one of the first position and the second position is set on the basis of sheet information for determining whether an impact damage to the sheet occurs.

5. The method according to claim 4, wherein the sheet information includes at least one of size, thickness, stiffness, and type of a sheet.

6. The method according to claim 1, wherein the alignment unit is a reference fence that sets a reference position of the trailing edge of the sheet.

* * * * *